US005309657A

United States Patent [19]

Spencer

[11] Patent Number: 5,309,657

[45] Date of Patent: May 10, 1994

[54] ROTATABLE PICTURE FRAME

[76] Inventor: LaDarien Spencer, 8006 Coastway Dr., Rowlett, Tex. 75088

[21] Appl. No.: 976,957

[22] Filed: Nov. 16, 1992

[51] Int. Cl.[5] ..... G09F 11/02; A47G 1/06

[52] U.S. Cl. ..... 40/473; 40/502; 40/152.2

[58] Field of Search ..... 40/452, 473, 474, 475, 40/152, 152.1, 152.2, 156, 482, 470, 106.53, 428, 493, 502

[56] References Cited

U.S. PATENT DOCUMENTS

| | | | |
|---|---|---|---|
| 1,930,048 | 10/1933 | Harding et al. | 40/473 |
| 2,039,770 | 5/1936 | Birdsell et al. | 40/473 |
| 2,084,808 | 6/1937 | Hyde | 40/473 |
| 2,194,238 | 3/1940 | Weaver | 40/473 |
| 2,320,151 | 5/1943 | McConaughy | 40/473 |
| 2,572,454 | 10/1951 | Down et al. | 40/152.1 |
| 2,677,908 | 4/1954 | Clevenger | 40/473 |
| 3,590,505 | 7/1971 | Benchley | 40/473 |
| 3,952,437 | 4/1976 | Mitchell | 40/152.1 |
| 3,962,806 | 6/1976 | Eby | 40/473 |
| 4,608,773 | 4/1986 | White | 40/152.1 |

*Primary Examiner*—Clifford D. Crowder
*Assistant Examiner*—Larry D. Worrell, Jr.
*Attorney, Agent, or Firm*—S. Michael Bender

[57] ABSTRACT

A rotatable picture frame apparatus which is made up of a plurality of picture frames, a turntable for supporting the picture frames, a casing for supporting the turntable and a base for supporting the casing. The apparatus contains a motor which is connected to the turntable by a rotating shaft and a switch for turning the motor on and off. The apparatus may contain its own electrical supply in the form of batteries contained in the casing or it may be adapted to be connected to an external power source.

4 Claims, 4 Drawing Sheets

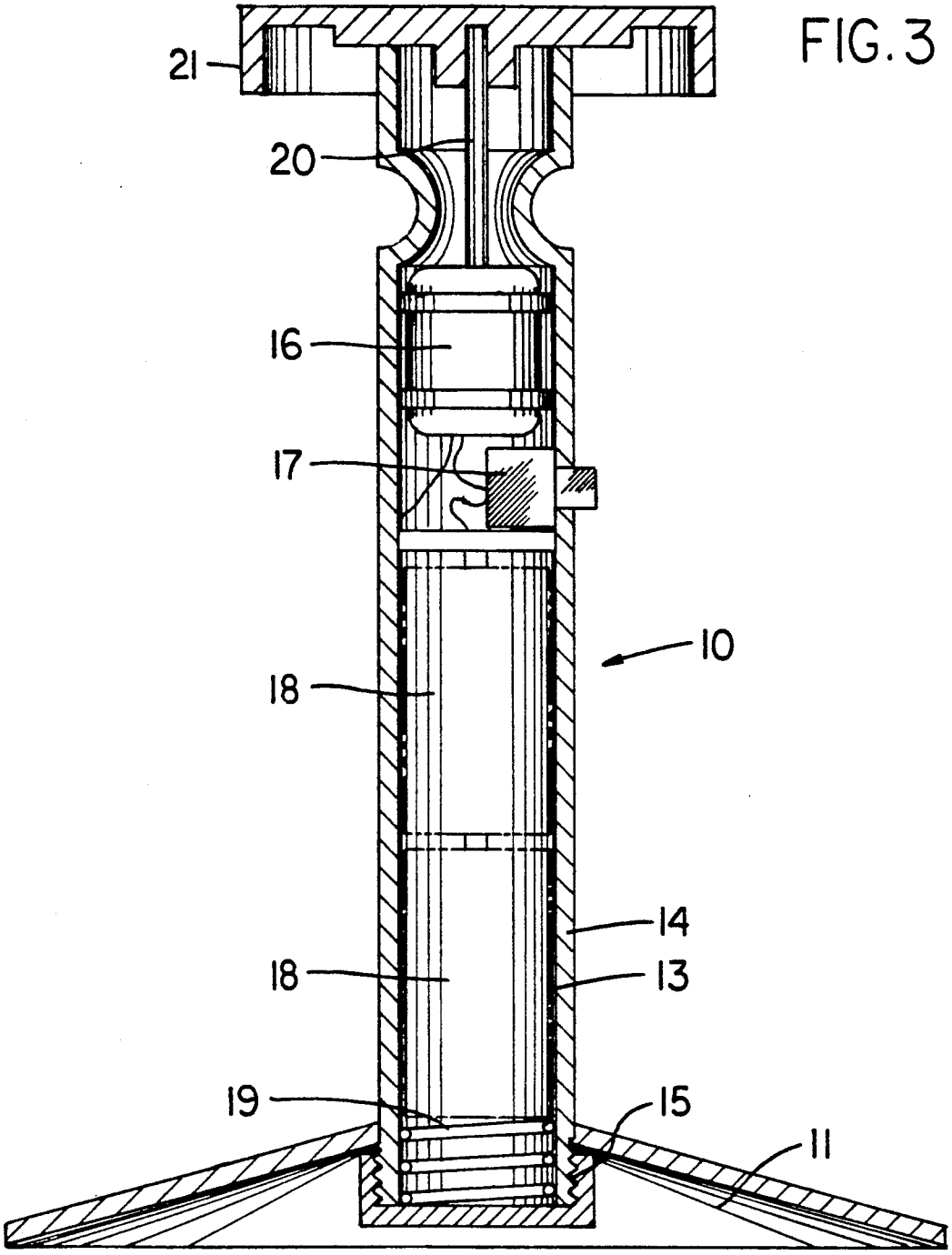
FIG. 3
FIG. 4
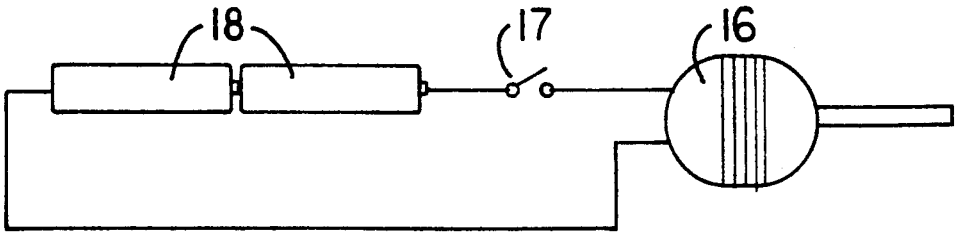

ROTATABLE PICTURE FRAME

BACKGROUND OF THE INVENTION

1. Field of the Invention

The present invention relates generally to picture frames, and more particularly, to an apparatus containing a plurality of picture frames mounted on a turntable supported by a casing and a base. The apparatus contains a motor which can slowly rotate the turntable.

2. Description of the Prior Art

Picture frames in the form of a plurality of connected picture frames are well known. For example, U.S. Des. No. 285,751 shows an apparatus containing a plurality of picture frames facing in a single direction. This apparatus is designed to remain stationary and is intended to be mounted on a wall. Similarly, U.S. Pat. No. 4,034,496 discloses an apparatus containing a plurality of picture frames facing in a single direction, which apparatus is adapted to be mounted on a wall. Also, picture holders in the form of cubes are known. These picture holders may contain one or more pictures on each face of the cube. Such picture holders may be placed on a desk or table and are designed to remain stationary.

Thus, while the foregoing body of prior art indicates it to be well known to use multiple-frame picture holders in a single apparatus, the provision of a simple and cost effective rotatable device is not contemplated. Nor does the prior art described above teach or suggest a multiframe picture-holding device which may conveniently be kept on a desk top and may be used by individuals who wish to view all of the pictures without manually moving the device. The foregoing disadvantages are overcome by the unique rotatable picture frame apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a rotatable picture frame apparatus which is made up of a plurality of picture frames, a turntable for supporting the picture frames, a casing for supporting the turntable and a base for supporting the casing. The apparatus contains a motor which is connected to the turntable by a rotating shaft and a switch for turning the motor on and off. The apparatus may contain its own electrical supply in the form of batteries contained in the casing or it may be adapted to be connected to an external power source. The apparatus may also serve as a lampstand, in which case a light source and shade are mounted above the turntable.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at least two preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved rotatable picture frame apparatus which has all of the advantages of the prior art and none of the disadvantages.

It is another object of the present invention to provide a new and improved rotatable picture frame apparatus which may be easily and efficiently manufactured and marketed.

It is a further objective of the present invention to provide a new and improved rotatable picture frame apparatus which is of durable and reliable construction.

An even further object of the present invention is to provide a new and improved rotatable picture frame apparatus which is susceptible of a low cost of manufacture with regard to both materials and labor, and which accordingly is then susceptible of low prices of sale to the consuming public, thereby making such rotatable picture frame apparatus available to the buying public.

Still yet a further object of the present invention is to provide a new and improved rotatable picture frame apparatus.

It is still a further object of the present invention is to provide a new and improved rotatable picture frame apparatus in combination with a lamp.

Still a further object of the present invention is to provide a new and improved rotatable picture frame apparatus including means for displaying a plurality of picture frames and rotating the picture frames so that each of the frames may be viewed by a person while remaining in the same position with respect to the apparatus.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 3 is a cross-sectional view of the rotatable picture frame apparatus of FIG. 1.

FIG. 4 is a schematic drawing of the electrical circuitry of the first preferred embodiment of the invention as shown in FIG. 3.

DESCRIPTION OF THE PREFERRED EMBODIMENTS

Figure 1:
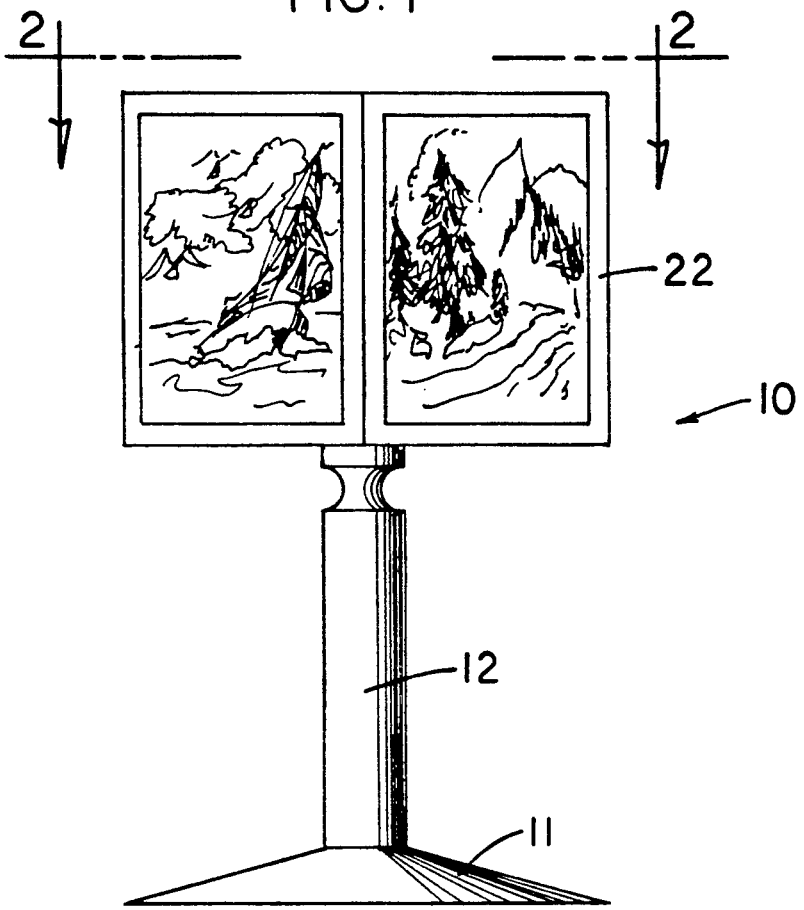
FIG. 1 is an elevational front view showing the first preferred embodiment of the rotatable picture frame apparatus of the invention.
Figure 2:
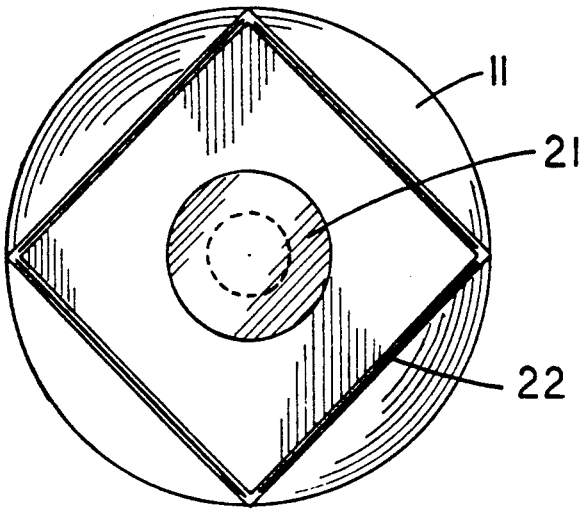
FIG. 2 is a top elevational view of the first preferred embodiment of the rotatable picture frame apparatus of the invention taken along line 2—2 of FIG. 1.

With reference now to the drawings, a new and improved rotatable picture frame apparatus embodying the principles and concepts of the present invention will be described.

Turning initially to FIGS. 1-4, there is shown a first exemplary embodiment of the rotatable picture frame apparatus of the invention generally designated by reference numeral 10. In one preferred form, the rotatable picture frame apparatus 10 comprises generally a horizontal base 11, a hollow longitudinal casing 12 having a central longitudinal axis and containing an inner wall 13 and an outer wall 14, and a horizontal turntable 21. The casing 12 is attached to the base 11 by threads 15. The casing holds a conventional battery-powered motor 16, an on/off switch 17 connected to the motor 16, batteries 18 secured in place by a spring 19 for providing a power source to the motor 16, and a rotatable drive shaft 20. The turntable 21 is fixedly connected to the rotatable drive shaft 20 and rotates slowly when the motor 16 is on. Alternatively, a set of meshing gears (not shown) between shaft 20 and turntable 21 may be provided. Picture frames 22 are fixedly connected to the turntable 21.

Figure 5:
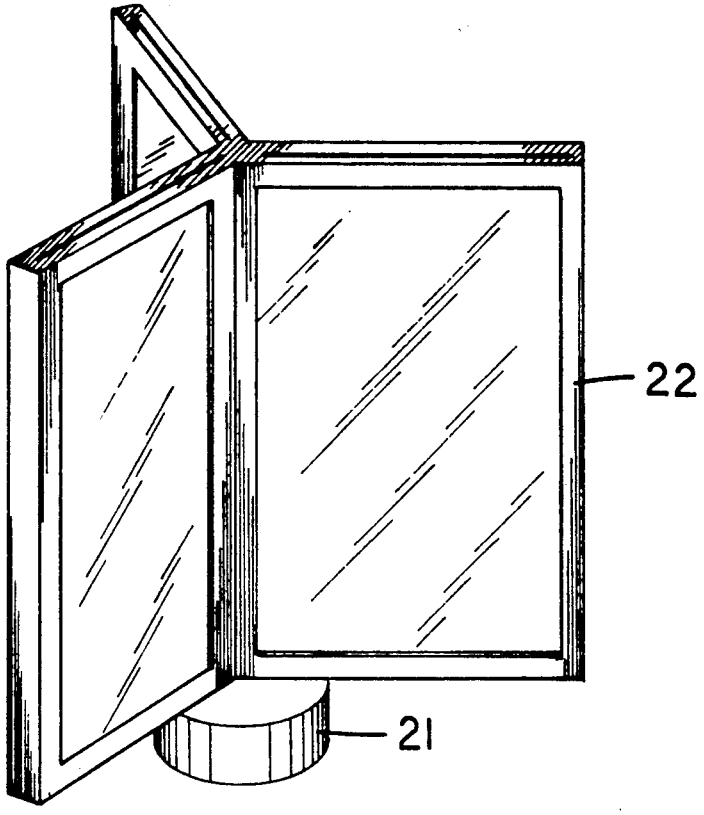
FIG. 5 is a perspective elevational view of one preferred embodiment of the arrangement of the picture frames.
Figure 6:
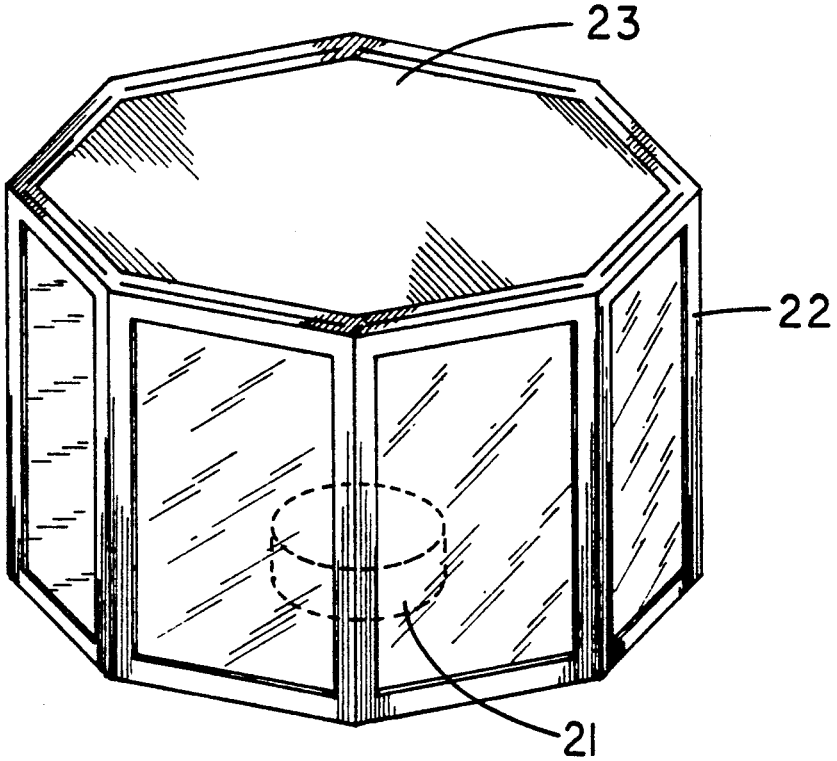
FIG. 6 is a perspective elevational view of another preferred embodiment of the arrangement of the picture frames.

FIGS. 5 and 6 depict alternate modes of attaching the frames 22 to the turntable 21. The frames 22, which face in a plurality of directions, may be directly fixedly attached to the turntable 21 by means of an adhesive as shown in FIG. 5 or the frames 22 may be connected to a plate 23 which is in turn fixedly attached to the turntable 21.

Figure 7:
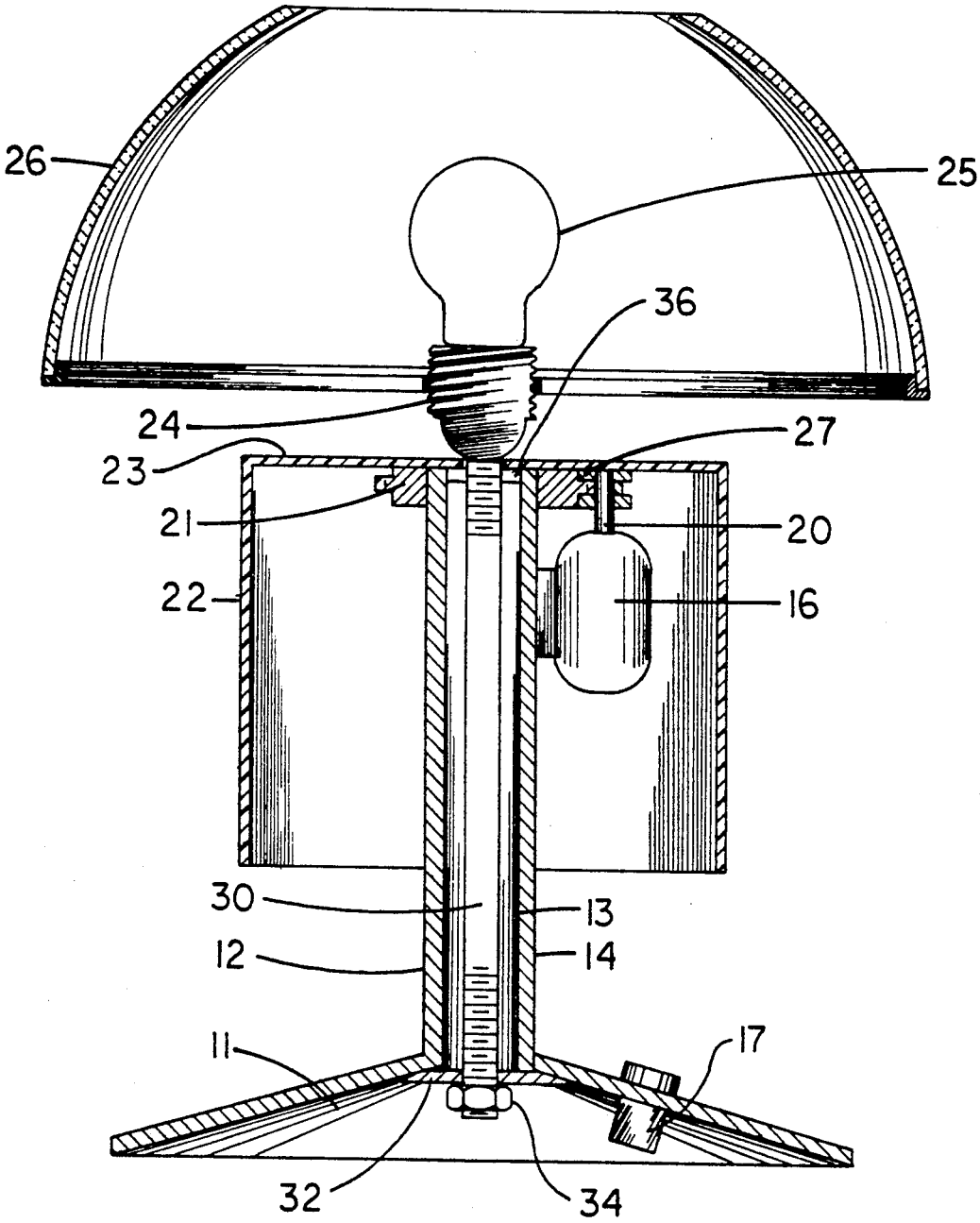
FIG. 7 is a cross-sectional view of the second preferred embodiment of the rotatable picture frame apparatus of the invention, depicting its use as a lampstand.
Figure 8:
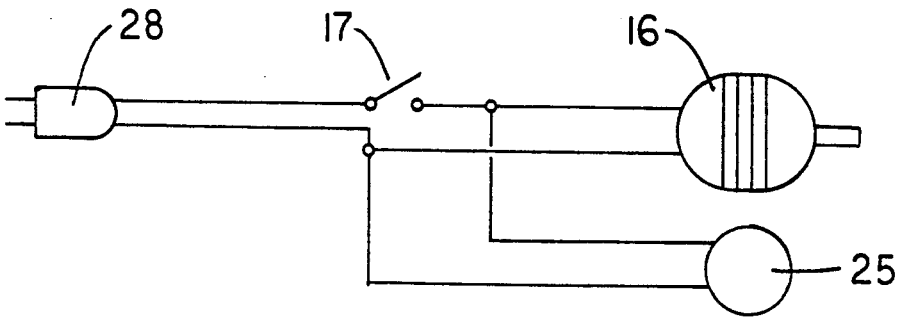
FIG. 8 is a schematic drawing of the electrical circuitry of the second preferred embodiment of the invention as shown in FIG. 7.

FIGS. 7 and 8 illustrate a second exemplary embodiment of the rotatable picture frame apparatus of the invention. This embodiment employs an electrical plug 28 which attaches to an outside power source, such as a 110 volt power supply (not shown). In this embodiment, the switch 17 is located in the horizontal base 11. The electrical power is supplied to the motor 16 and to a light socket 24 and light bulb 25 by suitable electrical wires (not shown) extending between plug 28, switch 17, motor 16, and light bulb socket 24, with the wives preferably being trained through the hollow interior of casing 12. A stud bolt 30 axially extending within the interior of casing 12 has one threaded end secured to bracket 32 via nut 34 and has its other end passing through a threaded bushing 36 suitably secured to the top end of casing 12. The light bulb socket, in turn, is suitably secured atop the other end of stud bolt 30 substantially as shown. The bulb is covered with a conventional lampshade 26, preferably opaque. The motor rotates the drive shaft 20, which, through meshed gears 27 (one on the drive shaft and the other on the outer circumference or rim of turntable 21), drives the rotatable turntable 21 slowly about the axis defined by fixed casing 12. In this embodiment, the picture frames 22 are fixedly attached to a plate 23 which is, in turn, fixedly attached to the turntable 21. A central aperture in plate 32 permits passage of the stud bolt end therethrough.

It is apparent from the above that the present invention accomplishes all of the objectives set forth by providing a new and improved rotating picture frame which adds color and variety to an office desk. The apparatus of this invention allows the office worker to view a variety of pictures without changing position or manually moving a multi-picture holder.

The apparatus of this invention may be made of any conventional material, such as metal or plastic. The base may be made in any of a variety of shapes and sizes, such as round, square and rectangular. The frames may be of any conventional size adapted to display pictures, such as wallet-size or 5" by 7".

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. A new and improved rotatable picture frame apparatus comprising:

a horizontal base, a vertical hollow casing attached to the base, said hollow casing having an inner wall, an outer wall, a central longitudinal axis, and top and bottom edges; a horizontal turntable having a perimeter rotatably mounted on said top edge of said casing, a motor for producing a rotating motion, said motor being mounted within said hollow casing and having a rotatable output shaft extending along said axis, said output shaft being connected to said turntable proximal to said top edge of said casing, an on/off switch for the motor mounted within said hollow casing and extending through said inner wall and said outer wall, said hollow casing further including batteries as a power source for said motor, said on-off switch being connected between said batteries and said motor; and a plurality of picture frames mounted upon said turntable; said hollow casing being removably mounted on said base to permit said batteries to be inserted within said hollow casing through the opening defined by said bottom edge thereof; and said picture frames having faces and being mounted on the turntable in such a manner that the faces of the picture frames are directed in a plurality of directions.

2. The invention of claim 1 wherein, the plurality of picture frames are joined along a line which is an extension of the longitudinal central axis of the casing.

3. The invention of claim 1 wherein, the plurality of picture frames are joined edge to edge and extend around the perimeter of the turntable.

4. The invention of claim 3 wherein, the picture frames project upwardly from the turntable.

* * * * *